US005679921A

United States Patent [19]

Hahn et al.

[11] Patent Number: 5,679,921

[45] Date of Patent: Oct. 21, 1997

[54] INFRA-RED TRACKING FLARE

[75] Inventors: George T. Hahn, China Lake, Calif.; Paul G. Rivette, Baton Rouge, La.; Rodney G. Weldon, China Lake, Calif.

[73] Assignee: The United States of America as represented by the Secretary of the Navy, Washington, D.C.

[21] Appl. No.: 757,645

[22] Filed: Aug. 27, 1958

[51] Int. Cl.[6] ..... C06B 45/10; C06B 27/00; D03D 23/00; F42B 4/26

[52] U.S. Cl. ..... 149/19.3; 149/19.91; 149/87; 149/108.2; 149/116; 102/336

[58] Field of Search ..... 102/34, 87, 60, 102/46, 336; 52/24, 23; 149/19.3, 19.91, 87, 108.2, 116, 20

[56] References Cited

U.S. PATENT DOCUMENTS 1,486,014 3/1924 Dutcher ..... 102/37.8

2,829,596 4/1958 Loedding ..... 102/87

*Primary Examiner*—Peter A. Nelson

*Attorney, Agent, or Firm*—Melvin J. Sliwka; Stephen J. Church

[57] ABSTRACT

This invention relates to flares; more particularly it relates to flares which are good emitters of infra-red radiation and which are adapted to be attached to rockets for tracking purposes.

1 Claim, 3 Drawing Sheets

INFRA-RED TRACKING FLARE

The invention described herein may be manufactured and used by or for the Government of the United States of American for governmental purposes without the payment of any royalties thereon or therefor.

In the generation of infra-red radiation for applicants' purposes, four considerations are of importance. First is the amount of heat that is liberated during the burning of the flare, since emissivity depends upon the temperature of the radiating material. Second is the rate of release of the heat since this rate determines how fast the radiating material is heated up. Third is the particular material which is radiating, as some materials are better emitters than others. Fourth is the particular wave length of the radiation emitted, since the detecting apparatus is sensitive to only certain wave lengths.

In the past, flares have been used which employed metal-nitrate, squib-ignited burning systems which were deficient in at least one of the aforementioned four qualities of the preceding paragraph. Also a steady flux of infra-red radiation was difficult to maintain with such flares because the ignition was not reliable, the burning was often erratic, and the flare composition was not always coherent during burning. Further, the radiation produced by such flares, of the desired length, 0.8 to 3.5 microns, was relatively weak.

It is therefore an object of this invention to provide a flare which has steady burning characteristics in order to maintain a steady flux.

Another object is to provide a flare which will produce infra-red radiation of 0.8 to 3.5 microns in wave length in greater quantities than previous flares.

With these and other objects in view, as will hereinafter more fully appear, and which will be more particularly pointed out in the appended claims, reference is now made to the following description taken in connection with the accompanying drawings in which like reference numerals designate like parts throughout the figures thereof and wherein:

FIG. 3 is a graph showing the amount of radiation emitted by the flare composition as a function of the amount of magnesium incorporated there in.

Figure 1:
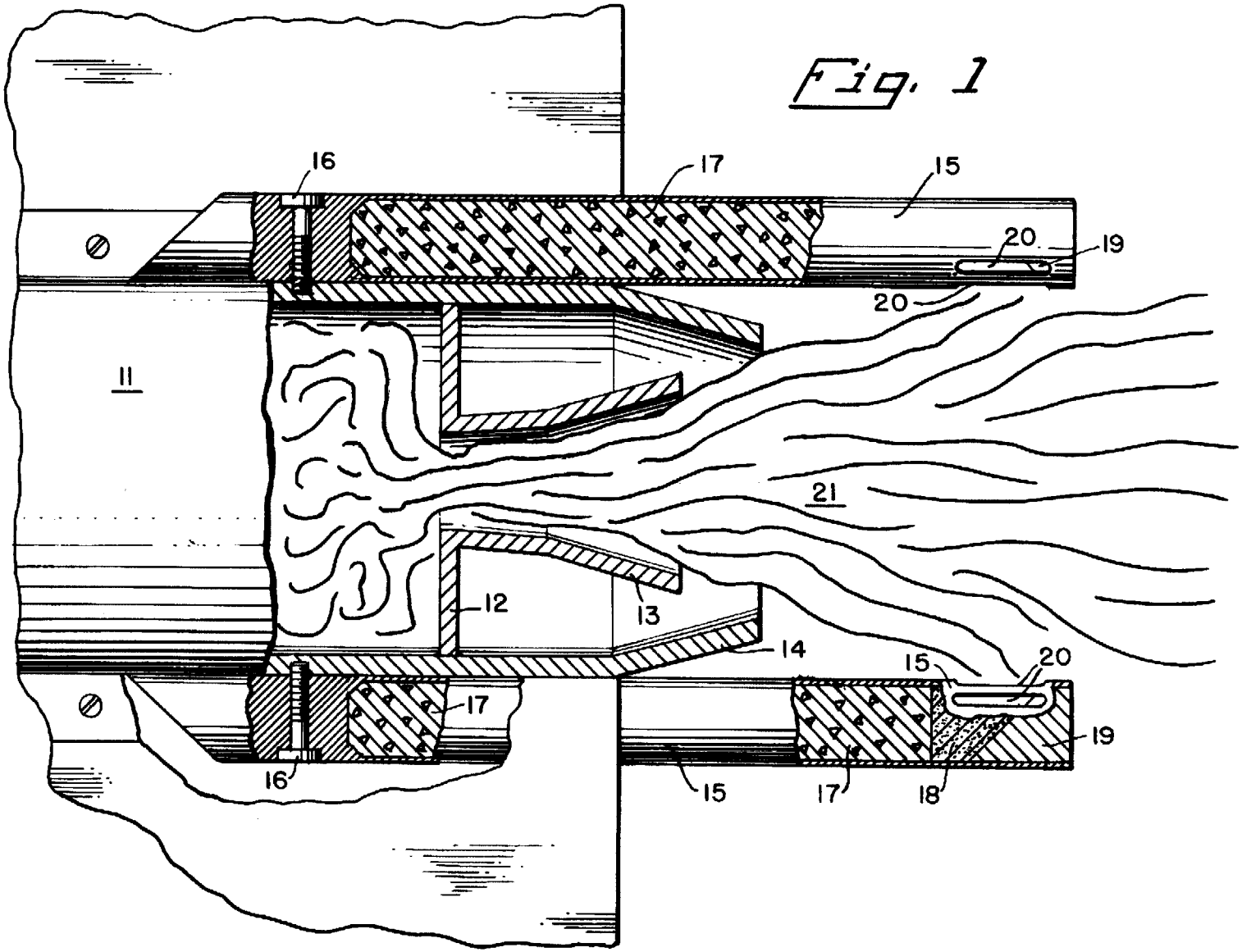
FIG. 1 is a cutaway view of the nozzle end of a rocket and an attached flare.

In FIG. 1 there is shown a rocket tube 11 having a nozzle plate 12, a nozzle 13, and a channel ring 14 attached thereto. Flare case 15 is mounted longitudinally upon the rocket tube and secured thereto with a screw 16. The flare case is hollow and is filled from the forward end with the flare composition 17. Adjacent the flare composition 17 and in contact therewith is the igniter composition 18. The hollow flare case is closed with an inert cap 19 which fits inside the tube. Slots 20 are provided in the back end of the case which are filled with an epoxy resin.

The flare case is mounted upon the rocket tube in such a fashion that the nozzle blast 21, which is substantially conical and defined by the nozzle cone, will impinge upon the slots 20, burn through the resin, and ignite the igniter material.

The slots 20 in the end of the flare case need not be filled with resin, but a thin metal foil may be wrapped around them instead. Holes may also be used instead of slots. The device is operative without such slots or holes but requires more time for initiation of burning than a flare with slots or holes.

The inert sealing cap may be any construction and may fit into the flare case or over it, and a plug may or may not be first inserted into the flare case before capping it.

Figure 2:
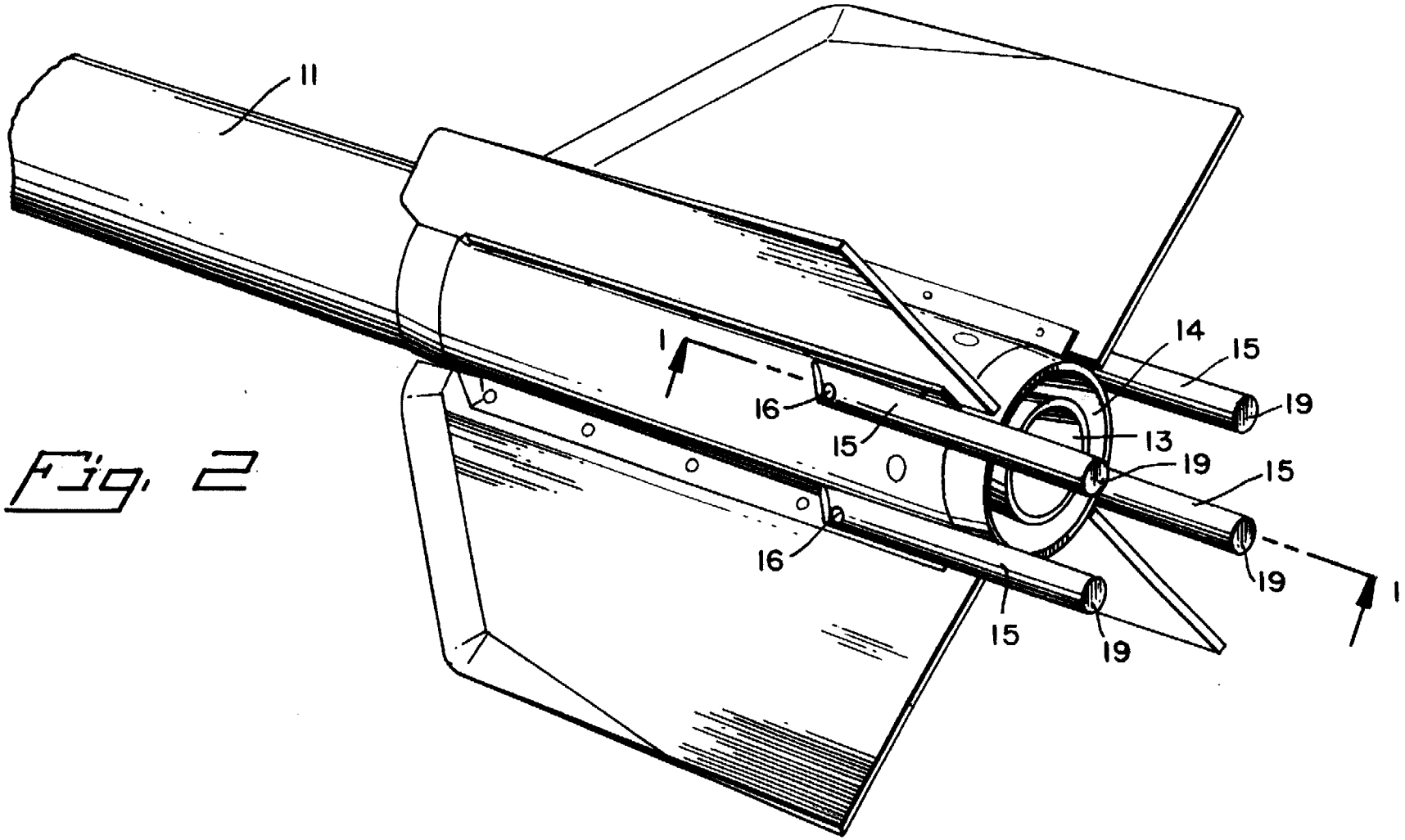
FIG. 2 is a perspective view of the nozzle end of a rocket with the instant flares attached.

FIG. 2 shows a perspective view of a rocket with the flares attached Any number may be attached to a rocket depending upon the amount of radiation desired.

The igniter composition is used in this case to ignite the flare because the flare is more difficult to ignite than prior flare materials. Reliable ignition is obtained by using a mixture of about 85 percent barium chromate, about 10 percent boron, and about five percent magnesium which has been screened through a 100 mesh screen and mechanically blended. Other igniters could be used but the mixture aforementioned is preferred for reasons pertaining to reliability.

The flare composition itself is a mixture of halogenated alkenes and magnesium. Polytetrafluoroethylene and polytrifluorochloroethylene, also known respectively as "Teflon" and "Kel-F" in commerce are preferred alkenes although others are operative. The proporation of magnesium is about 54–60 percent and the reminder is Teflon with a molecular weight between 100,000 and 1,000,000 and Kel-F with a molecular weight between 750 and 3,000 in about equal amounts. The proportion of Teflon and Kel-F can vary widely but the proportion of magnesium must remain in the aforementioned range for maximum emission, which is critical for the purpose of the inventors.

In operation, the nozzle blast of the rocket impinges upon the end of the flare case containing the igniter. The igniter then ignites and burns, blowing out the sealing cap and igniting the flare composition which end burns from rear to front. Once the flare composition is ignited, it will continue to burn even after the rocket propellant is burned out.

In compounding the flare composition comminuted Teflon and Magnesium which has been screened through a 25 mesh screen are mixed with Kel-F wax and blended. It is sometimes better to utilize more Kel-F than Teflon in order to provide a composition which is easier to blend.

The flare is easily made by packing the flare composition into the flare case until it is about 85 percent filled, then packing the igniter on top of the flare composition, and finally capping the case.

Figure 3:
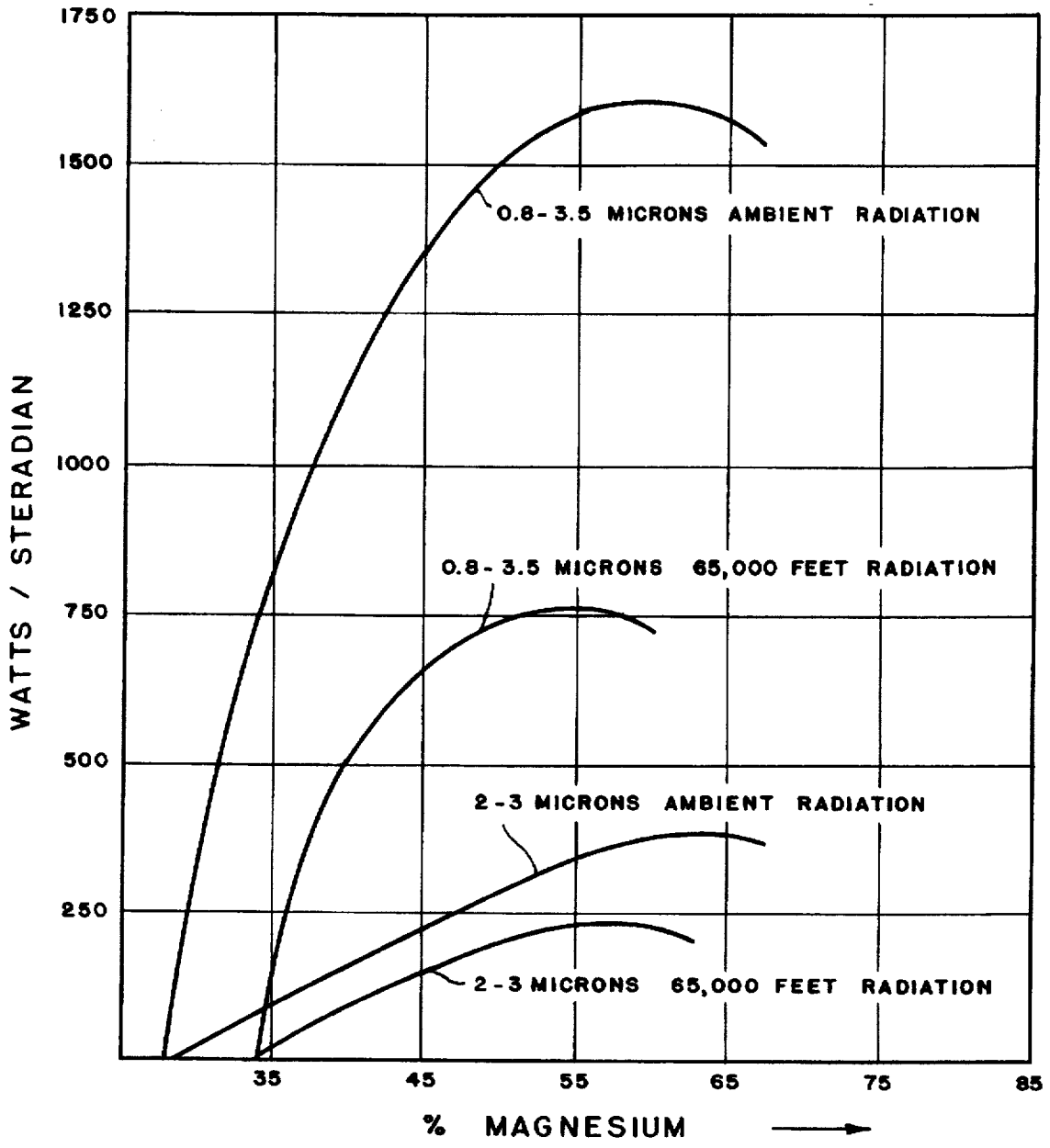

FIG. 3 represents a graph of the radiation emitted in watts per steridian as a function of the amount of magnesium incorporated in the flare. The ambient radiation is simply that emitted at sea level. The data for the graphs was obtained by burning the flares in an altitude chamber and measuring the radiation emitted with standard infra-red detecting apparatus. Radiation between the wave lengths of two to three microns is particularly useful in tracking and thus data on radiation of this wavelength is presented.

As can be seen from the graph, the curves reach a maximum and then begin to decline. This maximum occurs at a range of 54–60 percent magnesium, which is the reason for the limitation of the magnesium content to this critical range.

Presented below in Table I is a comparison of several flares as to total infra-red emitted, at ambient or sea level and at 65,000 feet. Data on typical prior art metal-nitrate flares are presented, as well as data on flares using other metals than magnesium with Teflon.

TABLE I

| Name of Flare | Composition | Watts/steradian per Sq. In. Burning Surface (0.8 to 3.5 Microns) | |
|---|---|---|---|
| | | Ambient | 65,000 Feet |
| 1. BuOrd Mk 21 Mk O | 54% Mg<br>34% $NaNO_3$<br>12% laminae | 677 | 500 |
| 2. Applicants' Flare | 54% Mg<br>23% Teflon<br>23% Kel-F | 2283 | 1070 |
| 3. Army "Rita" Flare | 66.7% Mg<br>28.5% $NaNO_3$<br>4.8% Binder | 1000 | — |
| 4. Optimum Aluminum-Teflon | 48% Al<br>52% Teflon | 1700 | — |
| 5. Optimum Boron-Teflon | 56% B<br>44% Teflon | 445 | — |
| 6. Optimum Zirconium-Teflon | 54% $ZrH_2$<br>46% Teflon | 428 | — |

It is readily apparent from the above data that the flare of this invention is far superior to the other flares at ambient level. While not all the figures are available as to emission at the 65,000 foot level, it is seen that the present flare is markedly superior to the metal-nitrate Bureau of Ordnance flare at this level and most probably is markedly superior to the others also.

From the foregoing, it is seen that a flare has been produced which is superior to prior-art flares. The reaction of magnesium with Teflon and Kel-F produces sufficient heat, and produces it fast enough to be quite useful as an infra-red source in the desired wave length. A further advantage is the fact that carbon, which is produced in the burning of the flare, is a very good emitter in the desired wave length range. Ignition of the flare is reliable and the burning is steady and even.

Obviously many modifications and variations of the present invention are possible in the light of the above teachings. It is therefore to be understood, that within the scope of the appended claims, the invention may be practiced otherwise than as specifically described.

What is claimed is:

1. An infra-red emitting flare composition comprising about 54–58 percent magnesia and the remainder a mixture of polymers of tetrafluoroethylene and trifluorochloroethylene in substantially equal amounts.

* * * * *